United States Patent [19]

Wakita et al.

[11] 4,168,686

[45] Sep. 25, 1979

[54] APPARATUS FOR PREVENTING THE DISCHARGE OF EVAPORATED FUEL GAS

[75] Inventors: Nobuaki Wakita; Michihiro Ohhashi, both of Susono, Japan

[73] Assignee: Toyota Jidosha Kogyo Kabushiki Kaisha, Toyota, Japan

[21] Appl. No.: 757,012

[22] Filed: Jan. 5, 1977

[30] Foreign Application Priority Data

Oct. 4, 1976 [JP] Japan ..... 51-119116

[51] Int. Cl.[2] ..... F02M 25/08

[52] U.S. Cl. ..... 123/136

[58] Field of Search ..... 123/136; 261/72 R; 220/85 VR, 85 VS; 55/DIG. 28, DIG. 41, 387

[56] References Cited

U.S. PATENT DOCUMENTS 3,617,034 11/1971 Skinner ..... 123/136

3,683,597 8/1972 Beveridge et al. ..... 123/136

3,884,204 5/1975 Krautwurst et al. ..... 123/136

*Primary Examiner*—Charles T. Jordan

*Attorney, Agent, or Firm*—Koda and Androlia

[57] ABSTRACT

An apparatus for preventing the discharge of evaporated fuel gas including a charcoal canister for absorbing and temporarily storing fuel gas, a purge port placed in the intake passage of the carburetor of the engine, a passage for evaporated fuel connecting the purge port with the charcoal canister so that the evaporated fuel that has become stored in the charcoal canister is supplied to the engine during operation of the engine by means of the negative pressure in the air passage, a second purge port which opens to a venturi section of the carburetor, a second passage for evaporated fuel which connects the second purge port with the charcoal canister and a check valve which is placed in the second passage which allows a flow only in the direction of the venturi section.

5 Claims, 2 Drawing Figures

APPARATUS FOR PREVENTING THE DISCHARGE OF EVAPORATED FUEL GAS

BACKGROUND OF THE INVENTION

1. Field of Invention

This invention relates to devices for reducing the pollution created by an engine of a motor vehicle and more particularly, to apparatuses for preventing the discharge of evaporated fuel gas into the environment from a motor vehicle.

2. Prior Art

Conventional devices for preventing the discharge of evaporated fuel gas consist of a charcoal canister made of activated charcoal which absorbs and temporarily stores evaporated fuel gas, a purge port which is placed inside the intake passage of a carburetor of the engine and a passage for evaporated fuel connecting the purge port with the charcoal canister. When the engine is operated, evaporated fuel which has been stored in the charcoal canister is sucked out into the air intake passage by means of a negative pressure and is burned in the engine.

When it becomes necessary to purge a large quantity of evaporated fuel gas by means of a conventional device for preventing the discharge of evaporated gas described above, the cross section of the purge port mentioned above must be enlarged in order to increase the flow rate. An increase in the cross section of the purge port, however, gives rise to various difficulties. When the canister is fully loaded with evaporated gas to a level near saturation, especially at the time of starting the engine, the mixed gas becomes overly rich. On the other hand, when the canister is in a sufficiently purged state, at a time of ordinary driving, the mixture of gases becomes too lean and this affects the operation and capability of the engine.

SUMMARY OF THE INVENTION

Accordingly, it is the general purpose of the present invention to provide an apparatus for preventing the discharge of evaporated fuel gas capable of purging a large quantity of evaporated fuel without adversely affecting the operational capability of the engine of the motor vehicle.

It is yet another object of the present invention to provide an apparatus for preventing the discharge of evaporated gas which is simple and easy to manufacture.

In keeping with the principles of the present invention, the objects are accomplished by a unique apparatus for preventing the discharge of evaporated fuel gas into the atmosphere including a charcoal canister which absorbs and temporarily stores evaporated fuel gas, a purge port which is placed in the intake passage of a carburetor of the engine, a first passage for evaporated fuel connecting the purge port with the charcoal canister such that the evaporated fuel which has become stored in the charcoal canister is sucked into the intake passage of the engine of the motor vehicle and burned in the engine by the negative pressure in the intake passage when the engine is started, a second purge port which opens to a venturi section of the carburetor, a second passage for evaporated fuel which connects the second purge port to the charcoal canister and a check valve which is provided in the second passage and which allows a flow only in the direction of the venturi section. By means of this apparatus it is possible to purge a small quantity of evaporated gas when the rate of air intake is low, for example, at times of starting and low speed operation, as well as a large quantity of gas when the rate of air intake is large, for example, at times of acceleration and high speed operation.

BRIEF DESCRIPTION OF THE DRAWINGS

The above mentioned and other features and objects of the present invention will become more apparent by reference to the following description taken in conjunction with the accompanying drawings, wherein like reference numerals denote like elements and in which.

DESCRIPTION OF THE PREFERRED EMBODIMENTS

Figure 1:
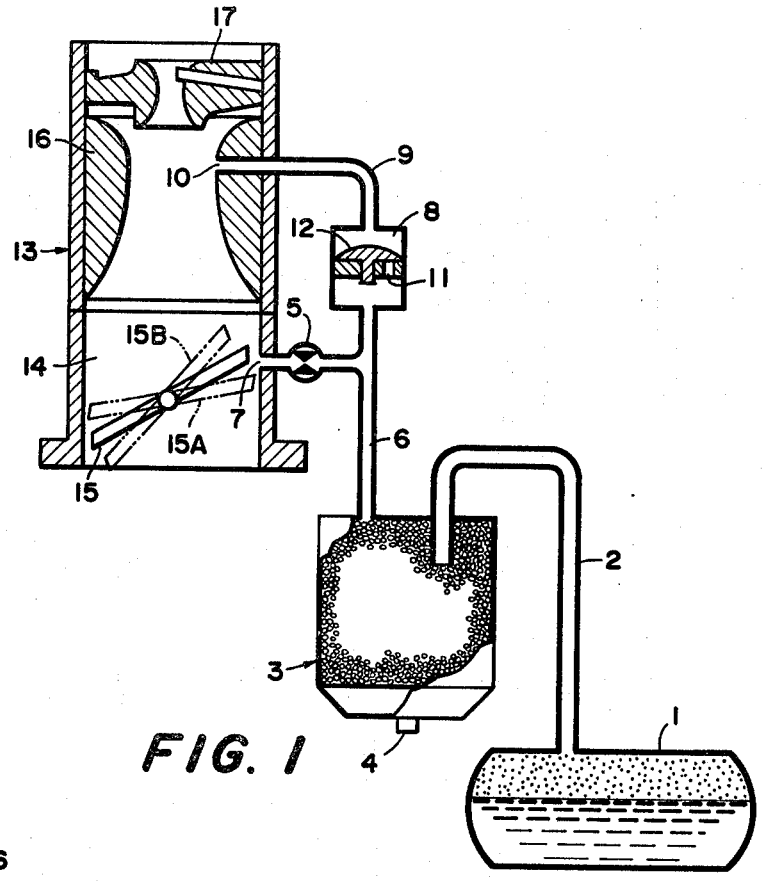
FIG. 1 is a cross-sectional diagram showing an apparatus for preventing the discharge of evaporated fuel gas in accordance with the teachings of the present invention.

Referring more particularly to the drawings, FIG. 1 is a cross-sectional view of an apparatus for preventing the discharge of evaporated gas in accordance with the teachings of the present invention. In FIG. 1, a charcoal canister 3 is coupled to the top portion of fuel tank 1 by a pipe 2. The canister 3 contains activated charcoal so that fuel gas which is evaporated from the inside of the fuel tank 1 is absorbed and temporarily stored therein.

At the bottom of the charcoal canister 3, there is provided an opening 4 through which atmospheric air can be introduced. The top portion of the canister 3 is coupled to first purge port 7 by means of a passage 6 for evaporated fuel. Passage 6 is further provided with a first fixed orifice 5. Furthermore, first purge port 7 is provided in the intake passage of the carburetor 13. Passage 6 for evaporated fuel is further connected to a second purge port 10 by a second passage 9 for evaporated fuel which is also provided with a check valve 8. The check valve 8 consists of a second fixed orifice 11 provided in the passage 9 and a valve part 12 which opens and closes so as to only allow a flow through the second fixed orifice 11 in a direction from the charcoal canister 3 towards the second purge port 10.

The first purge port 7 described above opens into the intake passage 14 of the carburetor 13 at a point slightly upstream from the idling position of the throttle 15. The second purge port 10, on the other hand, opens into the large venturi 16 of the carburetor 13. The cross-sectional area of the second fixed orifice 11 is several times greater than the first fixed orifice 5. The ratio of these cross-sectional areas need only be equal to that of the effective cross-sectional areas of the passage 6 and the second passage 9. Consequently, the cross-sectional area of the passage may be determined by the areas of the first purge port 7 and the second purge port 10.

In operation, when the engine is idling or decelerating, the throttle 15 is in the position 15A. Therefore, it is downstream from the first purge port 7 so that the purge port 7 will experience no negative pressure. Since the rate of air intake is very small, there is hardly any negative pressure on the second purge port 10 opening into the large venturi 16. As a result, almost no evaporated fuel will be sucked out through the first purge port 7. Furthermore, since the check valve 8 is not open, evaporated fuel is not sucked out through the second port 10 at all. Therefore, when the engine is being started, idled or decelerated, its operation is not adversely affected because the mixture of the gases becomes too rich or too lean.

During ordinary city driving, the opening of the throttle 15 is in the neighborhood shown by the solid lines in FIG. 1 so that the purge port 7 is situated downstream of the throttle 15. For this reason, there will be a large negative pressure on the first purge port 7 and evaporated fuel is sucked from the charcoal canister 3 through the passage 6 and the first fixed orifice 5 and into the intake passage 14 through which it is supplied to the engine. If the opening of the throttle 15 is small, the rate of air intake is small and a negative pressure acting on the second purge port 10 of the large venturi 16 is also small so that the check valve 8 remains closed and evaporated fuel is not sucked out through the second purge port 10.

Figure 2:
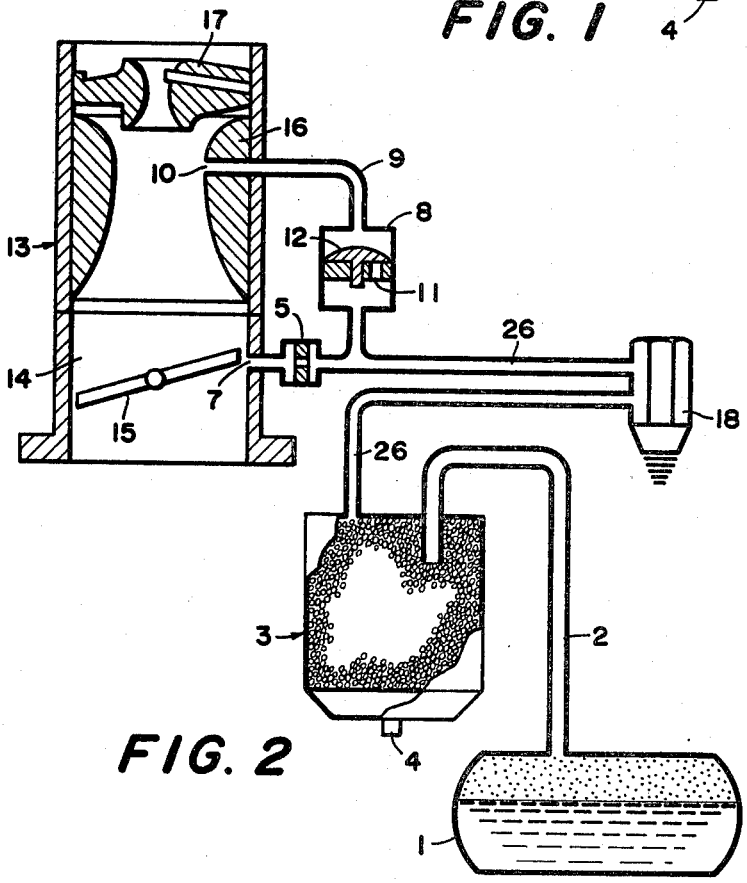
FIG. 2 is a cross-sectional diagram of a second embodiment of an apparatus for preventing the discharge of evaporated fuel gas in accordance with the teachings of the present invention.

When the engine is accelerated or running at a high speed, the opening of the throttle 15 becomes large as shown by the position 15B so that the rate of air intake also increases. When there is a high rate of air intake through the carburetor 13, there is a large negative pressure applied to purge port 7 and also to second purge port 10. The large negative pressure on second purge port 10 causes check valve 8 to open and evaporated fuel gas to flow through second fixed orifice 11 and into venturi 16. Accordingly, since evaporated fuel gases drawn through first and second purge ports 7 and 10 when the engine is accelerating or running at a high speed, a large amount of evaporated fuel gas can be drawn out of canister 3 by the negative pressure applied to first and second purge ports 7 and 10 and burnt in the engine without adversely affecting the operation of the engine. Referring to FIG. 2, shown therein is a second embodiment of an apparatus for preventing the discharge of evaporated fuel gas. In FIG. 2, the structure and operation of the apparatus for preventing the discharge of evaporated fuel gas is substantially the same as that shown in FIG. 1 except that a heat sensitive valve 18 is provided in the passage 6. Since FIG. 2 is substantially the same as that of FIG. 1, like elements of FIG. 2 are given like reference numerals and a description of their operation and interconnection will be omitted.

In FIG. 2, the heat sensitive valve 18 provided in the passage 16 is designed such that it is closed when the temperature of the engine is below a certain temperature and above another temperature. In this way, evaporated fuel gas is prevented from being drawn into the carburetor 13 and burnt by the engine when the engine is cold and attempted to be started. Since it is always hardest to start a cold engine, the addition of the heat sensitive valve 18 prevents the apparatus from preventing the discharge of evaporated fuel gas from adding to the difficulties of starting a cold engine. Also, the addition of evaporated fuel gas is prevented when the engine is too hot to prevent damage to the catalytic converter.

Since, as discussed above, a device for preventing the discharge of evaporated fuel gas in accordance with the teachings of the present invention operates such that the teachings of the present invention operates such that the amount of evaporated fuel gas sucked out can be small when the engine is idling or being started, or being large when the engine is running or being accelerated, so that it is possible to prevent the gas mixture from becoming too rich or too lean at the time of starting to provide adequate purging of the canister 3 when the engine is running fast. As a result, stable operation of the engine is possible while the apparatus has excellent characteristics regarding the emission of evaporated fuel gas.

It should be apparent to one skilled in the art that the above described embodiment is merely illustrative of but one of the many possible specific embodiments which represent the application of the principles of the present invention. Numerous and other varied arrangements can be readily devised by those skilled in the art without departing from the spirit and scope of the invention.

We claim:

1. An apparatus for preventing the discharge of evaporated fuel gas in a motor vehicle of the type having an engine and a carburetor, said apparatus comprising:
   - a charcoal canister for absorbing and temporarily storing evaporated fuel gas;
   - a first purge port provided in an intake of said carburetor of said engine;
   - a first passage for evaporated fuel gas connecting said purge port with said charcoal canister;
   - a second purge port provided in a venturi section of said carburetor;
   - a second passage for evaporated fuel gas connecting said second purge port with said charcoal canister;
   - a check valve provided in said second passage thereby allowing a flow only in the direction to the venturi section when said engine is accelerated or running at a high rate; and
   - a heat sensitive valve provided in said first passage, said valve being closed when said engine temperature is below a first predetermined temperature and when said engine temperature is above a second predetermined temperature.

2. An apparatus according to claim 1 wherein the effective cross-section of said second purge port is substantially greater than that of said first purge port.

3. An apparatus according to claim 1 wherein said first passage is provided with a first fixed orifice and said second passage is provided with a second fixed orifice having a cross-sectional area substantially greater than said first fixed orifice.

4. An apparatus according to claim 3 wherein said first purge port is provided upstream from a carburetor throttle of said engine when said carburetor throttle is in an idling position.

5. An apparatus for preventing the discharge of evaporated fuel gas in a motor vehicle of the type having an engine and a carburetor, said apparatus comprising:
   - a charcoal canister for absorbing and temporarily storing evaporated fuel gas;
   - a first purge port provided in an intake of said carburetor of said engine, said first purge port being provided upstream from a carburetor throttle of said engine when said carburetor throttle is in an idling position;
   - a first passage for evaporated fuel gas connecting said purge port with said charcoal canister;
   - a first fixed orifice provided in said first passage;
   - a second purge port provided in a venturi section of said carburetor;
   - a second passage for evaporated fuel gas connecting said second purge port with said charcoal canister;
   - a second fixed orifice provided in said second passageway, said second fixed orifice having a cross-sectional areas substantially greater than said first fixed orifice; and
   - a check valve provided in said second passage thereby allowing a flow only in a direction to the venturi section when said engine is accelerated or running at a high rate.

* * * * *